United States Patent [19]

Clegg

[11] Patent Number: 4,565,906

[45] Date of Patent: Jan. 21, 1986

[54] RECIPROCATING REVERSE-CIRCUIT SWITCH

[76] Inventor: John E. Clegg, 2320 Keystone Dr., Orlando, Fla. 32806

[21] Appl. No.: 696,551

[22] Filed: Jan. 30, 1985

[51] Int. Cl.[4] ..... H01H 9/00

[52] U.S. Cl. ..... 200/1 V; 200/17 R

[58] Field of Search ..... 200/1 V, 16 F, 17 R, 200/18, 153 LB, 153 S, 163

[56] References Cited

U.S. PATENT DOCUMENTS

| | | | |
|---|---|---|---|
| 706,084 | 8/1902 | Moskowitz | 200/1 V |
| 2,807,684 | 9/1957 | Ayers | 200/1 V |
| 3,637,967 | 1/1972 | Braun | 200/1 V X |
| 3,649,780 | 3/1972 | Johnson | 200/1 V |
| 3,800,103 | 3/1974 | Hardi-Kern et al. | 200/1 V |
| 3,947,391 | 3/1976 | Lutzenberger | 200/16 F X |
| 4,074,099 | 2/1978 | Steen | 200/153 S |
| 4,450,323 | 5/1984 | Iitsuka | 200/1 V |

*Primary Examiner*—J. R. Scott

[57] ABSTRACT

A switch operated by a reciprocating pin mounted to the base of an electromagnetic reciprocator, which is a motor with a coil that retrieves electricity stored in the electromagnetic field of a permanent magnet. The switch consists of a reciprocating plastic block with two adjacent parallel grooves which engage the reciprocating pin. The pin strikes a curve at the end of each groove and causes the block to reciprocate in a direction perpendicular to the direction of reciprocation of the pin. Two terminal arms mounted on the block alternately contact two pairs of terminal posts connected to the coils of electromagnets in the electromagnetic reciprocator, reversing the circuit through the coils and the polarity of the electromagnets and causing the electromagnets to alternately attract and repel the permanent magnet. The switch operates the electromagnetic reciprocator, and the electromagnetic reciprocator operates the switch.

1 Claim, 2 Drawing Figures

RECIPROCATING REVERSE-CIRCUIT SWITCH

BACKGROUND

Prior art includes U.S. Pat. No. 3,649,780 by Johnson and U.S. Pat. No. 4,450,323 by Iitsuka with rotary means of reversing the circuit; U.S. Pat. No. 3,800,103 by Hardi-Kern and U.S. Pat. No. 4,074,099 by Steen with reciprocating means of reversing the circuit.

Circuits in the above switches are reversed by hand levers or by fluid-pressure actuators. None of the switches is capable of automatically and continuously reversing the circuit for prolonged periods of time, which is the original, distinct and unique feature of the switch disclosed herein.

DRAWINGS

DESCRIPTION

Figure 1:
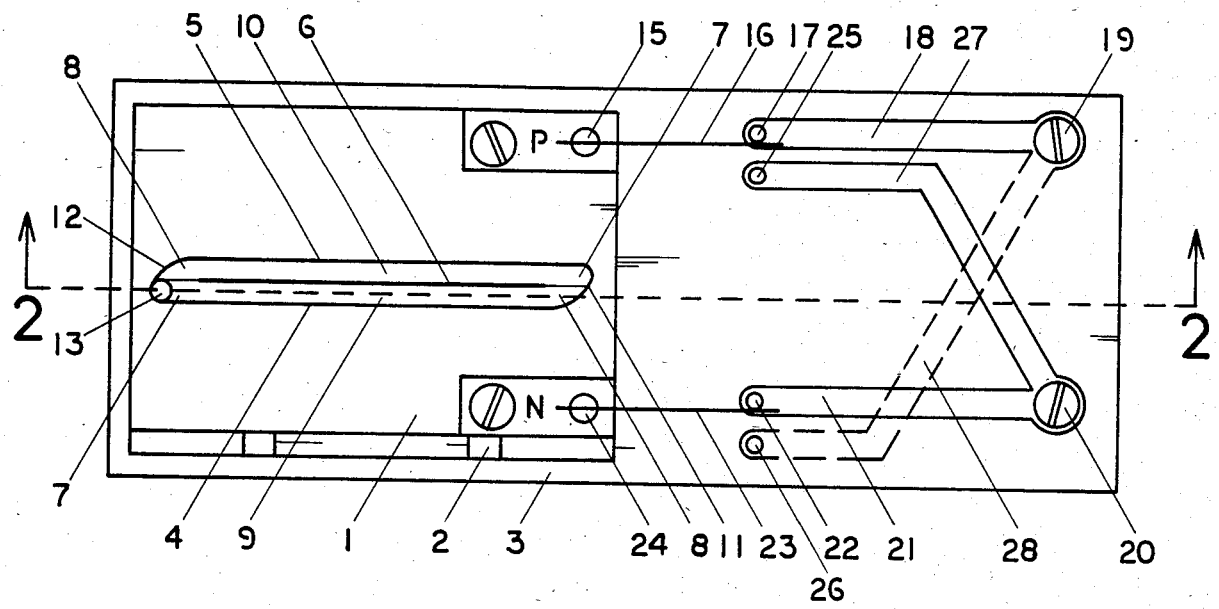
FIG. 1 is a plan view of the reciprocating reverse-circuit switch.
Figure 2:
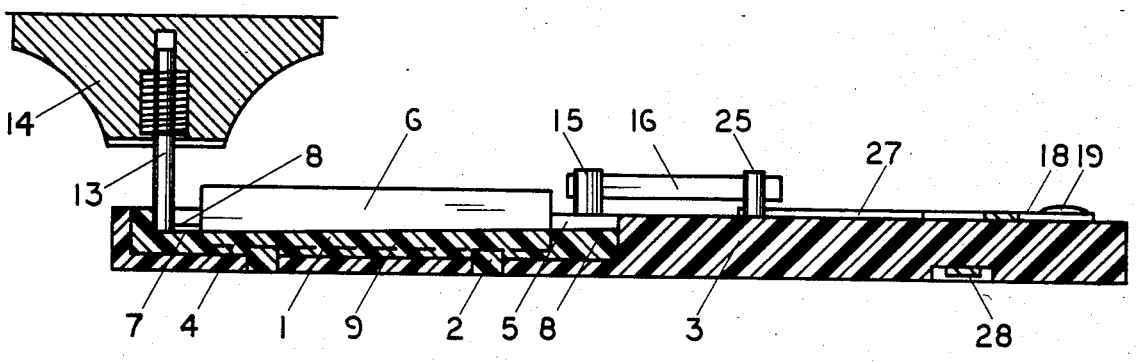
FIG. 2 is a cross section taken on line 2—2 of FIG. 1.

FIG. 1 is a plan view of the reciprocating reverse-circuit switch showing reciprocating plastic block 1 mounted on horizontal transverse tracks 2 in plastic housing 3. Two adjacent parallel grooves 4 and 5 are separated by vertical plate 6 which is embedded at its base in block 1, as shown in FIG. 2.

The bottoms of grooves 4 and 5 slope upward in opposite directions from a low end 7 to a high end 8, forming ramp 9 in groove 4 and ramp 10 in groove 5.

Each groove 4 and 5 curves inward at the end of the groove, forming curve 11 and curve 12.

Reciprocating pin 13 is mounted in housing 14 to the bottom of the electromagnetic reciprocator or device (not shown) and is equipped with a compression spring which exerts downward pressure on the pin.

The circuit through the switch as shown in FIG. 1 is as follows: positive (P) main terminal post 15, terminal arm 16, parallel post 17, parallel connector 18, terminal 19, electromagnetic coils (not shown), terminal 20, parallel connector 21, parallel post 22, terminal arm 23 and negative (N) main terminal post 24.

The circuit is reversed when reciprocating pin 13 moves up ramp 9 of groove 4 and strikes curve 11, moving block 1 to the negative side of the switch. Pin 13 is forced down from high end 8 of groove 4 to low end 7 of groove 5. The current flows from terminal arms 16 and 23 to cross posts 25 and 26 and cross connectors 27 and 28, and the currents through the electromagnetic coils is reversed, as is the polarity in the electromagnets.

I claim:

1. A reciprocating reverse-circuit switch comprising in general a reciprocating plastic block (1) with positive and negative terminal posts, terminal arms and connectors which serve as means of reversing a direct current through an electromagnetic device, and comprising in particular;

a reciprocating plastic block (1) mounted on horizontal transverse tracks (2) in a plastic housing (3) so as to reciprocate thereon in a transverse direction perpendicular to the longitudinal centerline of the block, said reciprocating plastic block (1) having two adjacent parallel grooves (4,5) located on opposite sides of a vertical plate (6) embedded in and occupying the longitudinal centerline of the block, a reciprocating pin (13) mounted to the housing of an electromagnetic device, engaging one of two grooves (4,5), and reciprocating in a direction parallel to the longitudinal centerline of the block as means of actuating transverse reciprocating motion in the block, said grooves (4,5) having bottoms which are inclined upward in opposite directions from a low end (7) to a high end (8) so as to form ramps (9,10) which confine reciprocating pin (13) to one of said grooves (4,5) by controlling the elevation of reciprocating pin (13) in the respective groove, one of said grooves (4) having a curve (11) in the outer wall at one end of the groove, said curve (11) deflecting said reciprocating plastic block (1) in a transverse direction by engaging reciprocating pin (13) at the end of a stroke, said deflection forcing reciprocating pin (13) from the high end (8) of one of said grooves (4) into the low end (7) of the other of said grooves (5), the other of said grooves (5) having a curve (12) in the outer wall at one end of the groove, said curve (12) deflecting said reciprocating plastic block (1) in a transverse direction by engaging reciprocating pin (13) at the end of a stroke, said deflection forcing reciprocating pin (13) from the high end (8) of the other of said grooves (5) into the low end (7) of one of said grooves (4), said reciprocating plastic block (1) having a positive (P) main terminal post (15) and a terminal arm (16) communicating with a parallel post (17) as means of conducting a direct current through parallel connector (18) and terminal (19) to the electromagnetic device, and having a negative (N) main terminal post (24) and terminal arm (23) communicating with parallel post (22) as means of conducting a direct current through parallel conductor (21) and terminal (20) to the electromagnetic device, a reciprocating plastic block (1) having a positive (P) main terminal post (15) and a terminal arm (16) communicating with a cross post (25) as means of conducting a direct current through cross conductor (27) and terminal (20) to the electromagnetic device, and having a negative (N) main terminal post (24) and a terminal arm (23) communicating with cross post (26) as means of conducting a direct current through cross conductor (28) and terminal (19) to the electromagnetic device.

* * * * *